United States Patent [19]

McCannon et al.

[11] 3,977,548

[45] Aug. 31, 1976

[54] CYLINDER ATTACHMENT MEANS FOR AN EXCAVATOR AND METHOD FOR USING THE SAME

[75] Inventors: Michael Benjamin McCannon, Sugar Grove; Richard Charles Zielie, North Aurora, both of Ill.

[73] Assignee: Caterpillar Tractor Co., Peoria, Ill.

[22] Filed: Oct. 24, 1974

[21] Appl. No.: 517,423

[52] U.S. Cl. ..... 214/138 R; 212/144

[51] Int. Cl.[2] ..... E02F 3/32

[58] Field of Search ..... 214/77, 131 A, 130, 214/131, 140, 776, 138 R; 212/144

[56] References Cited

UNITED STATES PATENTS

| | | | |
|---|---|---|---|
| 2,691,452 | 10/1954 | Wells, Jr. et al. | 214/131 |
| 3,581,919 | 6/1971 | Karlsson | 214/138 |

FOREIGN PATENTS OR APPLICATIONS

| | | | |
|---|---|---|---|
| 1,121,146 | 7/1968 | United Kingdom | 214/131 A |

*Primary Examiner*—Robert J. Spar
*Assistant Examiner*—Ross Weaver
*Attorney, Agent, or Firm*—Phillips, Moore, Weissenberger, Lempio & Strabala

[57] ABSTRACT

A mobile excavator comprises a tracked undercarriage having an upper unit rotatably mounted thereon. A boom is pivotally mounted on the upper carriage and has a dipper arm pivotally mounted at a forward end thereof, the dipper arm in turn having a dipper mounted on its lower end. A double-action hydraulic cylinder is interconnected between the boom and an upper end of the dipper arm to selectively pivot the dipper arm on the boom. Attachment means are mounted on the boom to releasably attach the cylinder thereto upon removal of the dipper arm and its attendant structures for transport of the excavator.

6 Claims, 4 Drawing Figures

CYLINDER ATTACHMENT MEANS FOR AN EXCAVATOR AND METHOD FOR USING THE SAME

BACKGROUND OF THE INVENTION

Large construction machines, such as hydraulic excavators, are often towed to a remote job site by another vehicle. It has proven advantageous to remove the dipper arm and its attendant structures from the boom of the excavator to facilitate such transportation. The dipper arm is also disconnected from a double-acting cylinder, utilized to selectively pivot the dipper arm on the boom during earthworking operations, which remains connected to the boom to thus subject it and its attendant hydraulic lines to damage.

SUMMARY OF THE INVENTION

An object of this invention is to provide an economical means and method for expeditiously attaching the free end of a hydraulic cylinder to a member of a construction vehicle upon transportation thereof. In the preferred embodiment of this invention, the construction vehicle constitutes a hydraulic excavator normally comprising a boom pivotally mounted on a forward end thereof and a dipper arm pivotally mounted on a forward end of the boom. Attachment means, mounted on the boom, are disposed intermediate the ends of the cylinder for attaching it to the boom upon removal of the dipper arm.

BRIEF DESCRIPTION OF THE DRAWINGS

Other objects of this invention will become apparent from the following description and accompanying drawings wherein.

DETAILED DESCRIPTION

Figure 1:
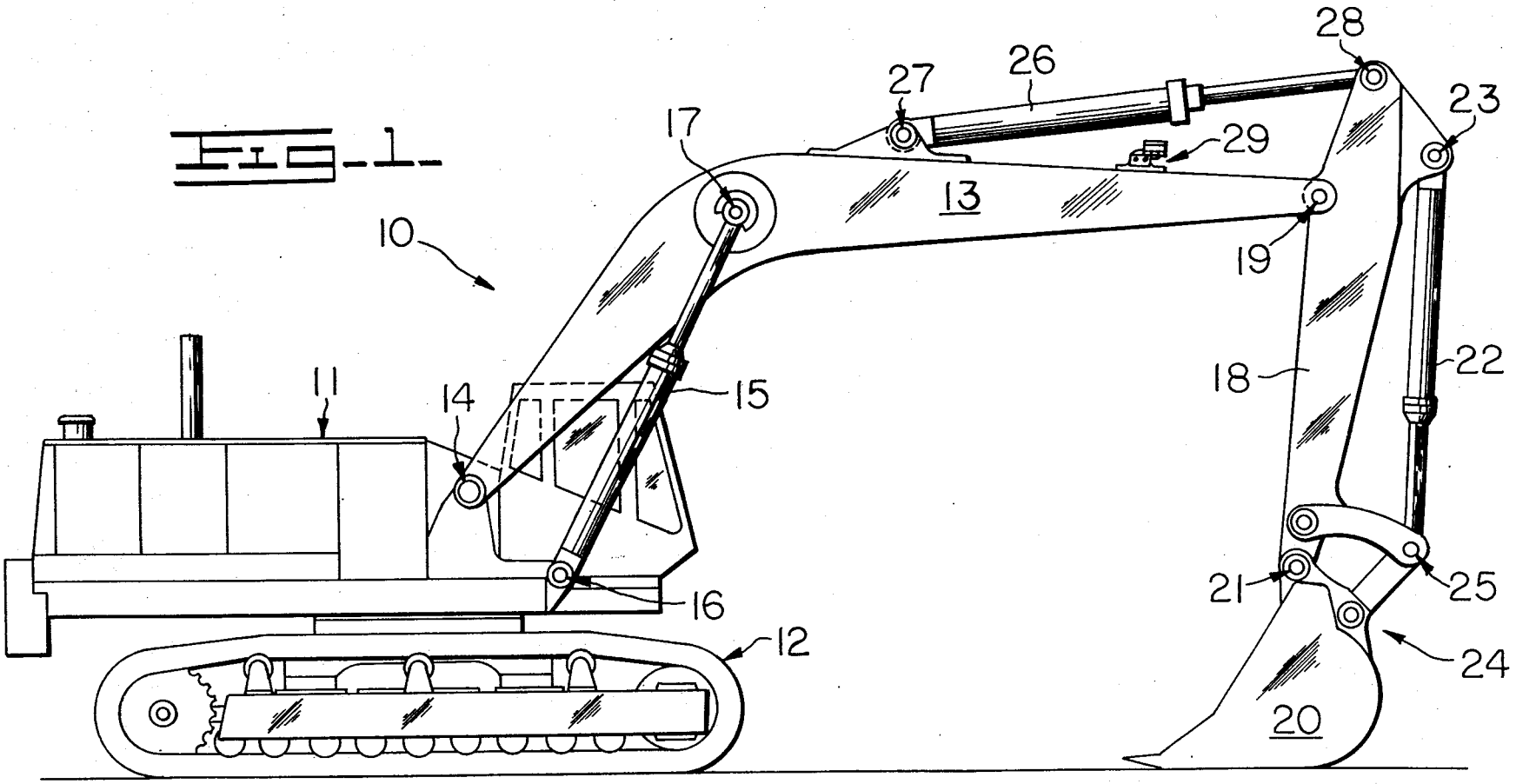
FIG. 1 is a side elevational view of a hydraulic excavator having a bracket assembly of the cylinder attachment means of this invention mounted on a boom thereof.

FIG. 1 illustrates a hydraulic excavator 10 comprising an upper unit 11 rotatably mounted on a tracked undercarriage or car body 12 in a conventional manner. A boom or member 13 is pivotally mounted by pivot means 14 on a forward end of the upper unit and is adapted to be raised or lowered vertically by a pair of double-acting hydraulic cylinders 15 (one shown) interconnectd between the upper unit and the boom by pivot means 16 and 17, respectively. A dipper arm 18 is pivotally connected to a forward end of the boom by a releasable pivot means 19 and has a work tool in the form of a dipper or bucket 20 pivotally mounted on a lower end thereof by a pivot means 21.

A double-acting hydraulic cylinder 22 has its upper end pivotally connected to the dipper arm by a pivot means 23 and a lower end thereof pivotally connected to a linkage 24 by a pivot means 25 to selectively pivot the dipper on the dipper arm. A double-acting hydraulic cylinder 26 has a first end thereof pivotally mounted on the boom by a pivot means 27 and a second end thereof connected to an upper end of dipper arm 18 by a releasable pivot means 28. In accordance with the teachings of this invention, cylinder 26 is adapted to be releasably attached to boom 13 by a releasable attachment means comprising a bracket assembly 29 mounted on the boom.

Figure 3:
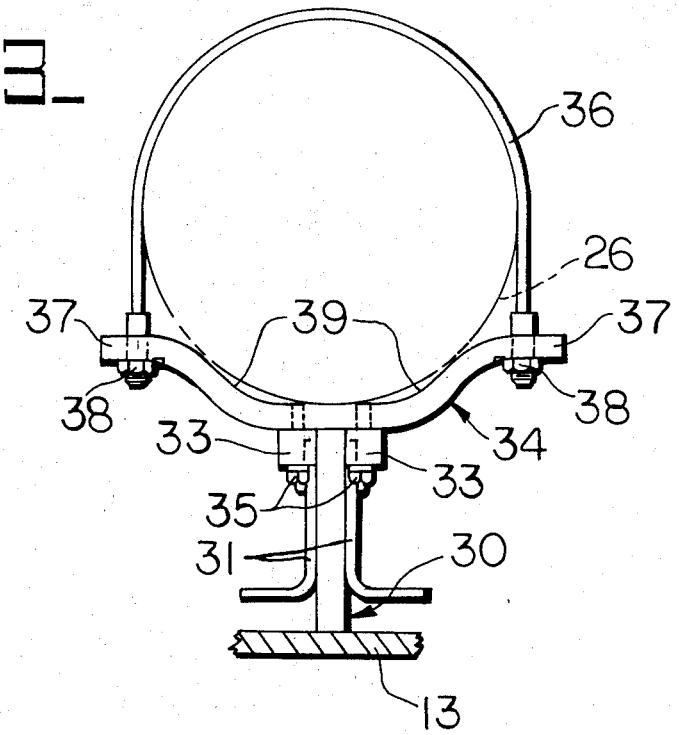
FIGS. 2 and 3 are enlarged side and front elevational view of the bracket assembly, respectively, with FIG. 3 further illustrating a cylinder attached thereto.
Figure 2:
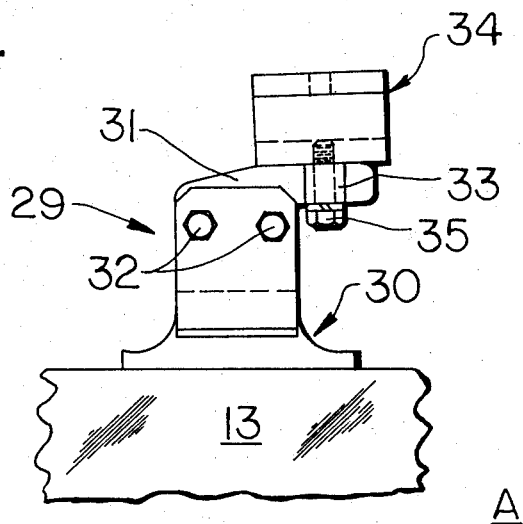

Referring to FIGS. 2 and 3, the bracket assembly comprises a support bracket 30 welded or otherwise suitably secured to a top of the boom. Plate assemblies 31 are releasably attached to bracket 30 by a pair of capscrews 32 and support hydraulic lines (not shown). The bracket 30 has a pair of spacers 33 suitably welded on either side thereof and a cradle-like member 34 releasably attached on the spacers by a pair of capscrews 35.

Figure 4:
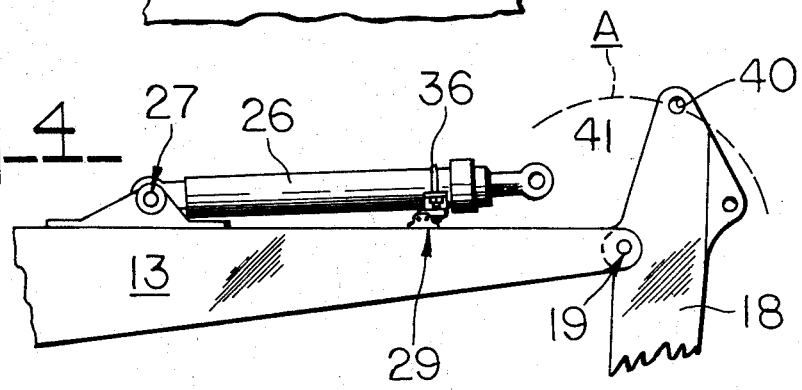
FIG. 4 is a partial side elevational view of the boom having the cylinder attached thereto by the cylinder attachment means.

Referring to FIGS. 1 and 4, the rod end of cylinder 26 is disconnected at pivot means 28 from the upper end of dipper arm 18 upon transport of the excavator to a remote job site or the like. The dipper arm and attendant structures are removed from boom 13, by disconnecting pivot means 19, to transport them as a separate unit. Cylinder 26, remaining connected at pivot means 27 to the boom, is pivoted onto bracket 29 and secured thereon by a suitable strap or cable 36 (FIGS. 3 and 4).

The free ends of the cable are suitably secured to each outwardly-extending arm 37 of member 34 by a respective nut 38. As shown in FIG. 3, the cradle member forms a generally concave seat 39 thereon. Such seat receives a peripheral portion of the cylindrical housing of cylinder 26 in nesting relationship therewith to cooperate with cable 36 to prevent movement of the cylinder relative to the boom.

It should be noted in FIG. 4 that means, defining an aperture 40 through an upper end of the dipper arm for pivotal attachment to an aperture 41 formed through the rod or second end of cylinder 26, is disposed on the dipper arm for pivotal movement through an arc A. It should be further noted that pivoting of the dipper arm through such an arc will place apertures 40 and 41 in non-aligned relationship, when cylinder 26 is fully retracted, to prevent inadvertent assemblage of pivot means 28 (FIG. 1) when cable 36 secures the cylinder to the boom.

We claim:

1. In a construction vehicle comprising a boom having a first end thereof pivotally mounted on a frame of said vehicle, actuating means pivotally interconnected between said frame and said boom for selectively raising or lowering said boom, a dipper arm having first means on an upper end thereof and pivotally mounted intermediate its ends of a second end of said boom, a work tool mounted on a lower end of said dipper arm, a first end of a double-acting hydraulic cylinder pivotally mounted on said boom, and wherein a second end of said cylinder, having second means thereon for attachment to the first means of said dipper arm, is maintained in unattached relationship on said vehicle, the invention comprising attachment means mounted on said boom and releasably attaching said cylinder thereto in a storage position thereon, intermediate the ends of said cylinder, whereby upon release of said attachment means said first and second means can be attached together to attach the second end of said cylinder to the upper end of said dipper arm.

2. The vehicle of claim 1 wherein said cylinder is fully retracted and said first means is disposed on the upper end of said dipper arm for pivotal movement into non-aligned relationship relative to second means formed on the second end of said cylinder for normal pivotal connection to the means formed on the upper end of said dipper arm.

3. The vehicle of claim 1 wherein said work tool constitutes a dipper and further comprising means interconnected between said dipper arm and said dipper for selectively pivoting said dipper.

4. The vehicle of claim 1 wherein said attachment means comprises a bracket secured on said boom, said cylinder seated on said bracket.

5. The vehicle of claim 4 further comprising a cradle-shaped member, defining a generally concave seat thereon, attached on said bracket and disposed transversely relative to said boom, a cylindrical portion of said cylinder disposed on the seat of said bracket and at least generally conforming to the shape thereof.

6. The vehicle of claim 5 wherein said attachment means further comprises a cable having ends thereof each attached to a respective end of said cradle-shaped member, said cable partially encircling said cylinder and releasably attaching it on said member.

* * * * *